United States Patent [19]

Garnett et al.

[11] Patent Number: 4,781,117

[45] Date of Patent: Nov. 1, 1988

[54] FRAGMENTABLE WARHEAD OF MODULAR CONSTRUCTION

[75] Inventors: Charles R. Garnett, Dahlgren; William M. Henderson, Ninde, both of Va.

[73] Assignee: The United States of America as represented by the Secretary of the Navy, Washington, D.C.

[21] Appl. No.: 75,705

[22] Filed: Jul. 20, 1987

[51] Int. Cl.[4] ..... F42B 13/18

[52] U.S. Cl. ..... 102/493; 102/374; 102/473

[58] Field of Search ..... 102/491–497, 102/473, 287, 289–291, 293, 331, 374, 389, 465, 466, 467; 60/253, 255, 909

[56] References Cited

U.S. PATENT DOCUMENTS

| | | | |
|---|---|---|---|
| H219 | 2/1987 | Sayles | 102/287 |
| 109,600 | 11/1870 | Drake | 102/493 |
| 1,316,148 | 9/1919 | Enequist | 102/491 |
| 1,515,912 | 5/1945 | Sayles | 149/2 X |
| 2,413,008 | 12/1946 | Taglialetela | 102/2 |
| 2,798,431 | 7/1957 | Semon et al. | 102/67 |
| 3,881,416 | 5/1975 | Dilworth, Jr. | 102/63 |
| 4,118,262 | 10/1978 | Abbott | 60/909 |
| 4,284,007 | 8/1981 | Arnell et al. | 102/491 |
| 4,327,643 | 5/1982 | Barrios | 102/493 |
| 4,596,619 | 6/1986 | Marks | 102/285 |
| 4,648,323 | 3/1987 | Lawther | 102/495 |

FOREIGN PATENT DOCUMENTS

| | | | |
|---|---|---|---|
| 22151 | 5/1921 | France | 102/473 |
| 410527 | 10/1966 | Switzerland | 102/287 |

*Primary Examiner*—Harold J. Tudor

*Attorney, Agent, or Firm*—Elmer E. Goshorn; John D. Lewis

[57] ABSTRACT

An improved fragmentable warhead of modular construction for a missile and the like, that is generally made up of an intermediate warhead missile section and an explosive cartridge. The cartridge is selectively removable from the missile section thereby permitting the missile to be without an explosive charge until the missile is ready for tactical use. Moreover, the cartridge is of composite construction such that the outer shell of the cartridge is advantageously composed of an admixture of a suitable resin and a graphite material. By reason of this admixture the shell is not only of thin wall construction and of sufficient strength for handling the cartridge during storage and assembly, but also has sufficient electric characteristics so that the cartridge will not have electrostatic buildup that would detonate its explosive during handling and storage of the cartridge prior to assembly to a missile section. Moreover, the interior annular surface of the missile section is preferably provided with an appropriate grooved grid pattern for assisting in the formation of fragments of predetermined size when the cartridge is detonated. Furthermore, it has been found that the outer shell of the cartridge in being of thin wall construction does not adversely affect the detonation wave front of the explosive but in fact results in the fragments having a greater velocity than heretofore possible for impacting a target.

10 Claims, 2 Drawing Sheets

FRAGMENTABLE WARHEAD OF MODULAR CONSTRUCTION

This invention concerns a fragmentable warhead of modular construction; and, more particularly, it relates to an improved fragmentable warhead of modular construction for use as part of a missile section and the like where the warhead has a selectively removable explosive cartridge therein.

BACKGROUND OF THE INVENTION

In the past various fragmentable warheads have been offered. For example, U.S. Pat. No. 2,413,008 to Tagliatela discloses a fragmentation bomb of assembled components. The bomb is comprised of inner and outer shells as well as nose and tail pieces. The nose and tail pieces of the bomb when the bomb components are assembled together maintain and secure the sections in concentric relation to the bomb axis. The explosive is compartmented within the inner shell while two series of fragments of special, different shapes are fixed between the shells and about the outer shell. U.S. Pat. No. 2,798,431 to Semon et al. also concerns a fragmentation warhead for projectiles. The warhead is generally made up of an outer shell of dome-like shape. The shell between its ends is provided with a series of fragmentation rings of particular shape such as the pertinent species of FIGS. 2–3. However, the explosive charge is an integral part of the projectile as manufactured and thus is not removable once assembled to the projectile during projectile manufacture. U.S. Pat. No. 3,881,416 to T. E. Dilworth, Jr. relates to a choked flechette weapon system for a missile warhead or launch tube section. The system is generally made up of an open-ended plastic container for receiving and storing a plurality of flechettes or rod weapons prior to explosive launch of the rods from the forward tapered restrictive or choked end of the tube section. U.S. Pat. No. 4,648,323 to R. J. Lawther discloses a fragmentation munition that forms the warhead section of a missile. The missile is generally made of an inner container for enclosing an explosive. An outer tube together with opposed end covers concentrically mount and permanently fix the container with its explosive to the tube. The tube or shell forms an integral part of a missile when assembled thereto. A series of specially shaped fragments of two different sizes and wedge-shaped configuration are interposed between and affixed to the tube and container so as to form a unitized fragmentation munition. However, once the container is assembled to the tube with a series of fragments, the container is not readily removable from the tube. Further, once the container is filled with explosive (usually during manufacture of the munition itself) via the removable cap on one of the end covers the explosive is, for all practical purposes, not removed from a missile without removing the entire tube assembly of the missile that forms the munition. Hence, none of the aforediscussed references recognized the advantages of an improved fragmentation warhead where its explosive cartridge is readily removed from its associated warhead section of a missile. One of the advantages of such a missile warhead section in being of modular construction is that the explosive of the warhead section can be manufactured and stored separate from the missile warhead section until it is assembled into a tactical configuration thereby minimizing the handling and safety requirements for a missile until it is armed with an explosive cartridge.

SUMMARY OF THE INVENTION

An object of the present invention is to provide an improved fragmentation warhead or munition of modular construction for a missile section where the section and the explosive cartridge inserted therein lends itself to separate manufacture and handling thereby minimizing the danger in handling a warhead prior to its tactical use.

Another object of the present invention is to provide an improved fragmentation warhead or munition of modular construction for a missile section where an insertable explosive cartridge assembly of the missile section is of composite construction such that the outer shell of the assembly is of relatively thin wall construction and is composed of an admixture of nonmetallic materials that provides sufficient strength, buckle resistance and enhanced containment of a detonated explosive so as to provide better fragmentation of the section surrounding the cartridge assembly such that the section fragments impact a target at a greater velocity.

Still another object of the present invention is to provide an improved fragmentation warhead of modular construction for a missile warhead section and the like where a removable explosive cartridge assembly of the warhead section is provided with an outer shell essentially composed of an admixture of nonmetallic materials that can be readily formed in a precision manner and where the shell has sufficient electric conductive characteristics so as to minimize electrostatic buildup that would otherwise tend to accidentally detonate the explosive cartridge.

In summary, the invention relates to an improved fragmentation warhead of modular construction for a missile section and the like. The warhead is generally made up of a tubular section that forms the housing or casing of the missile. The tubular section is provided with an interior annular surface that defines an opening between its ends. An explosive cartridge of composite construction is selectively insertable and removable from the opening of the section in relation to the interior surface thereof.

To this end, the interior surface at one end is provided with retaining means for engaging the bottom end of a cartridge when inserted in the tubular section. The cartridge is provided with an outer shell of relatively thin-wall construction that is essentially composed of an admixture of suitable grades of resin and graphite materials. As a result, the shell not only has sufficient strength to resist buckling and denting during cartridge handling but also sufficiently contains the explosive when detonated so that its detonation wave front is maximized in shattering the shell and then impacting the surrounding area of the section so as to fragment and propel same at a greater velocity than heretofore possible for impacting a target. Moreover, since the shell can be precisely and readily formed by known manufacturing techniques, the outer diameter of the shell is slightly less than the inside diameter of the surrounding interior annular surface of the section so that the cartridge can be freely inserted in the section opening.

The outer end of the cartridge is provided with an outwardly extending annular flange the outer diameter of which is greater than the inside diameter of the interior surface of the section. Further, the cartridge-insertion end of the interior surface of the section is counterbored such that the diameter of the counterbore is slightly greater than the outside diameter of the flange. The depth of the counterbore is such that when the cartridge is fully inserted in the section opening. the cartridge flange abuts the shoulder between the counterbore and the section opening. The longitudinal extent between the retaining means and the shoulder is such that when the cartridge flange engages the shoulder the inner end of the cartridge abuts the retaining means. Consequently, when the flange is secured to the shoulder by appropriate fastening means or the like, the inserted cartridge is firmly secured between the retaining means and the flange while at the same time the cartridge is held in generally concentric and aligned relation to the longitudinal axis of the missile.

Depending on the explosive requirements of the cartridge in meeting the mission requirements of the missile, the length of the cartridge is normally less than the length of the tubular section. Consequently the section can be used to secure other components therein, such as an electronic fuse control package for the missile itself as mounted in the remaining unused compartmented area of the section. By reason of the cartridge being readily removable from the section, the electronics can be readily serviced or replaced as required.

In order to assist in fragmentation of the tubular section into fragments of substantially uniform and predetermined size, the interior annular surface of the section is normally provided with a grooved grid pattern of desired shape, grid size and extent. Hence, the grid pattern usually extends the same distance as the longitudinal extent of the cartridge while at the same time fully encompassing the circumference of the cartridge between its ends.

Other objects and advantages of the invention will become apparent when taken in conjunction with the specification and drawings as follows.

DETAILED DESCRIPTION OF THE INVENTION

Figure 1:
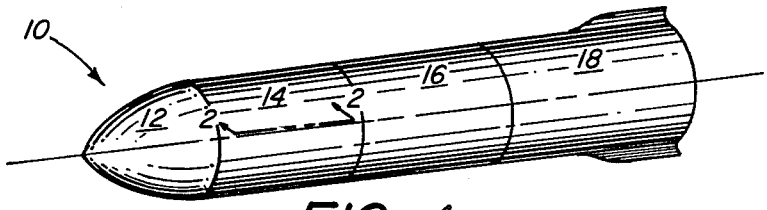
FIG. 1 is a perspective view of a representative missile where the improved warhead section thereof incorporates an embodiment of the invention.
Figure 3:
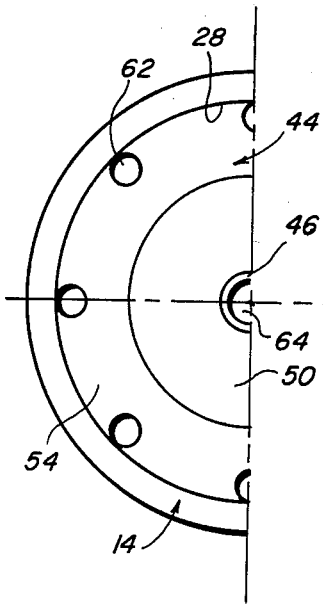
FIG. 3 is a partial end view as taken along line 3—3 of FIG. 2.

With further reference to FIG. 1, a missile 10 of typical configuration is generally made up of a series of four interconnected sections 12, 14, 16 and 18. Forward intermediate section 14 is usually the warhead section of missile 10. However, as the result of the modular construction of the invention as will become more fully apparent hereinafter, section 14 can also be used for receiving an electronic fuse control package.

Figure 2:
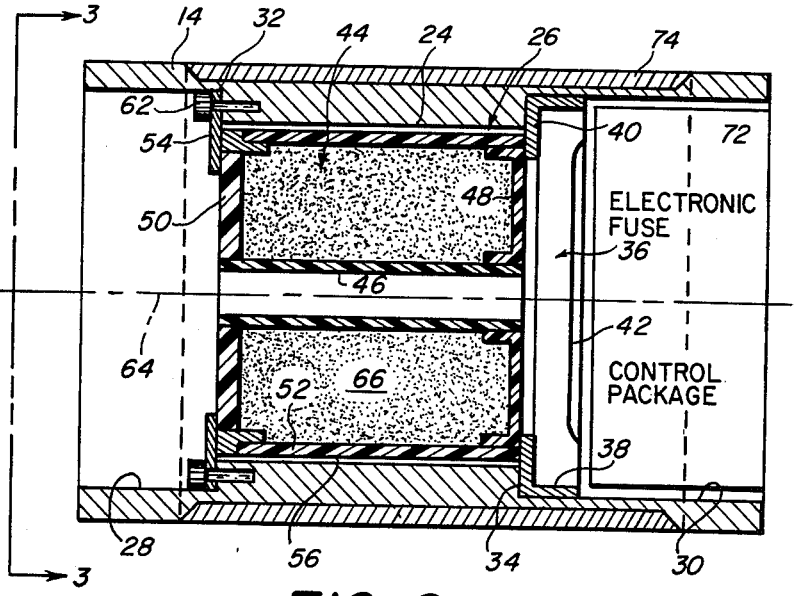
FIG. 2 is an enlarged longitudinal sectional view, with some parts removed, as taken along line 2—2 of FIG. 1 and illustrates further details of the invention.

As further illustrated in FIG. 2, section 14 is provided with an interior annular surface 24 defining an opening 26 therein. Either end of section 14 is counterbored so that interior annular surface 28 is of shorter length than interior annular surface 30. Surfaces 24 and 28 are interconnected by a radial shoulder 32. Similarly, surfaces 24 and 30 are also interconnected by a radial shoulder 34. A retaining element 36 of annular shape is provided with a circular-shaped peripheral portion 38 and an inwardly extending radial portion 40 integrally connected thereto. The outer surface of peripheral element 38 has an outside diameter substantially equal to the inside diameter of interior surface 30 of section 14. When element 36 is inserted in section 14, radial portion 40 of the element abuttingly engages shoulder 34. As evident in FIG. 2. the internal radial extent of radial portion 40 extends into opening 26 inwardly and beyond surface 24 such that the inner peripheral edge of portion 40 is of smaller diameter than the internal diameter of surface 24. If desired, one or more internal ribs may be provided for element 36 such as, e.g., one rib 42 as shown in FIG. 2. Retaining element 36 may be inserted in section 14 by being press fitted therein or otherwise firmly secured therein.

A selectively removable explosive assembly 44 of composite construction is inserted in section 14. Assembly 44 is generally made up of a core 46 of cylindrical shape, an annular-shaped bottom closure element 48, a top closure plate 50 of disc shape, an annular-shaped front supporting ring 52 and an outer circular flange 54 of flat shape. Core 46, plate 50 and flange 54 are preferably made up of a suitable grade of ferrous or nonferrous material or an alloy thereof. Bottom closure element 48 is preferably made of a suitable metallic or nonmetallic material. An outer shell 56 of relatively thin-wall and relatively rigid construction extends between and is connected to closure element 48 and ring 52. The outer peripheral surface of shell 56 has an outside diameter somewhat less than the inside diameter of interior surface 24 of section 14 so that assembly 44 can be freely inserted in opening 26. Also, the internal periphery of radial portion 40 of element 36 has an internal diameter less than the outside diameter of shell 56 of assembly 44. Further, outer shell 56 has a length substantially corresponding to the distance between shoulders 32 and 34 so that when assembly 44 is fully inserted in opening 26 from the left end of section 14 as viewed in FIG. 2, bottom closure plate 48 and the bottom end of shell 56 are both in abutting engagement with radial portion 40 of element 36. Moreover, by virtue of the composite construction of cartridge 44 it minimizes the overall weight of missile section 14 thereby enhancing the performance capabilities of missile 10.

Figure 4:
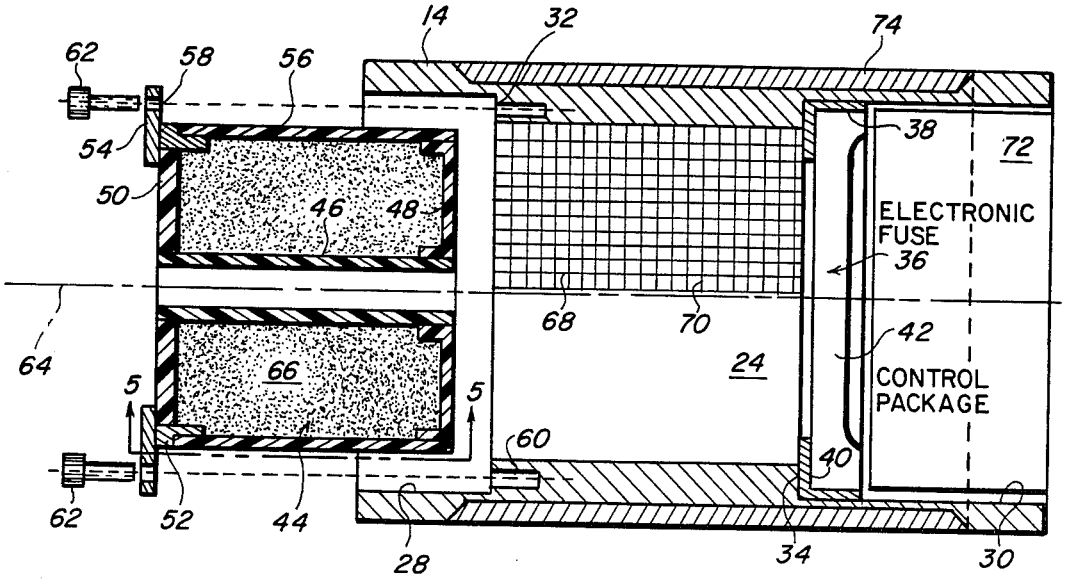
FIG. 4 is a longitudinal sectional view similar to FIG. 2 but with certain parts in exploded relation and with other parts added to further illustrate details of the invention.

Outer flange 54 is provided with a series of eight equally spaced and circumferentially arranged openings 58 about the outer periphery thereof as best shown in FIG. 4. Shoulder 32 is also provided with a series of eight axially extending threaded holes 60 with each hole of the series being of a preselected depth. Each of these holes 60 of the series of eight holes is equally spaced about the circumference of shoulder 32 such that each hole 60 is axially alignable with its associated opening of the series of eight holes 58 of flange 54. Both flange 54 and the series of openings 58 therein are concentrically disposed about the axis of assembly 44. Similarly, the series of eight holes 60 in shoulder 32 are concentrically disposed about longitudinal axis 64 of section 14. Assembly 44 is securely assembled to the interior of section 14 as depicted in FIG. 2 when each capscrew 62 of a series of eight capscrews 62 is passed through its associated opening 58 and then threadedly connected to its axially aligned and associated hole 60. Assembly 44 is then held with both plate 48 and shell 56 in positive abutting engagement with radial flange portion 40 of element 42. At the same time, assembly 44 is firmly held in concentric aligned relation with section 14 such that the axis of assembly 44 is generally aligned with axis 64 of section. 8y reason of the combined action of flange 54 and the series of cap screws 62 along with the positive engagement between assembly 44 and element 36, assembly 44 is generally maintained in alignment with axis 64.

During manufacture of assembly 44 in any appropriate manner, the assembly is suitably filled with a desired high energy explosive 66 after assembly of shell 56 to bottom plate 48. Upon filling of assembly 44 with explosive, top plate 50 and ring 52 are affixed between core 46 and shell 56 thereby fully enclosing the explosive. Then a detonator (not shown) of appropriate design can be inserted in core 46.

Outer shell 56 of assembly 44 is advantageously essentially composed of an admixture of a graphite material and a resin material. A suitable graphite material has been found to be either a graphite tape or a graphite filament. Similarly, a suitable resin has been found to be either a suitable grade of a polyester or an epoxy. By reason of this admixture, the outer shell of thin-wall construction has been found to exhibit sufficient rigidity without buckling during normal handling of assembly 44 prior to insertion in section 14. Also, shell 56 exhibits sufficient rigidity until it shatters when explosive 66 is detonated so that the detonated explosive is contained by shell 56 for a sufficient period of time to assure maximum energy from the detonation wave front of the explosive as it impacts the surrounding warhead fragmentation portion of section 14. Further, the admixture of shell 56 exhibits sufficient electric conductive characteristics that assembly 44 will not be subject to electrostatic buildup during handling of assembly 44 prior to assembly to section 14. If electrostatic buildup did occur, explosive 66 might be detonated thus endangering personnel.

As evident from FIG. 4, the surrounding warhead fragmentation portion of section 14 occurs between shoulders 32 and 34 where the cylindrical-shaped wall of section 14 exhibits its greatest thickness. To maximize fragmentation of the warhead portion internal surface 24 may be provided with a series of intersecting longitudinal and transversely extending grooves 68 and 70 of any desired depth or profile so as to form a desired grid pattern. For the sake of brevity, the grid pattern is shown only above axis 64 in FIG. 4, but it is to be understood that the grid pattern extends throughout the circumference and longitudinal extent of surface 24. By reason of this grid pattern of uniform shape, a plurality of fragments of preselected and uniform shape can be advantageously formed upon detonation of explosive 66 so that the explosively formed fragments impact a target with greater velocity than heretofore possible so as to provide greater assurance in destroying same all as the result of improved section 14 with enhanced cartridge 44 therein.

Since assembly 44 is selectively insertable into section 14, section 14 can also be used for other necessary components for operation of missile 10. To this end, the right end of section 14 as viewed in FIG. 1 is free to receive an electronic fuse control package 72 for controlling the detonation of explosive 66 of assembly 44. To control fuse package 72, the outer surface of section 14 is circumferentially and axially recessed for receiving an annular-shaped antenna 74. Hence, package 72 operates in response to signals received by antenna 74 during flight of missile 10.

Figure 5:
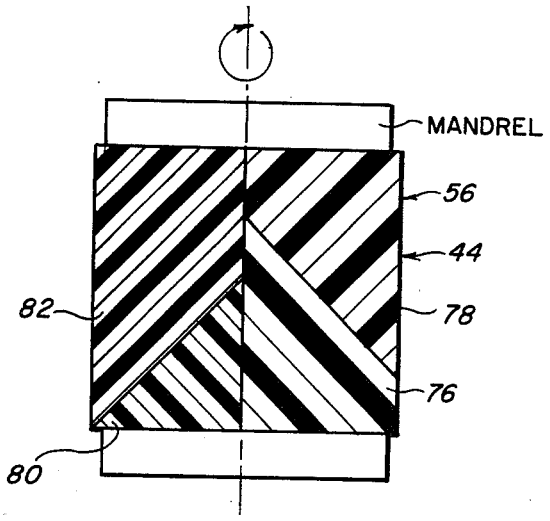
FIG. 5 is a side view taken along 5—5 of FIG. 2 but rotated clockwise ninety degrees (90°) from the position shown in FIG. 4 and with parts added on either side of the centerline to illustrate more than one embodiment of the invention as to a certain portion thereof.

Outer shell 56 of assembly 44 can be formed in any suitable fashion. One formation technique is to wrap graphite material about a rotating mandrel as shown in FIG. 5. To this end, a series of graphite tapes 76 for each wrap of tape are wound in the same direction edge-to-edge or overlapped and in substantially corresponding angular relation to the axis of assembly 44 such that overlapping tape wraps 76 and 78 are in criss-crossed and reversed angular relation to the axis of assembly 44. Similarly, a series of filaments 80 and 82 are provided for each criss-crossed wrap in another embodiment of shell 56. During progressive formation of a shell about a mandrel, a series of tape wraps, filament wraps or any combination thereof can be used. An appropriate resin material may be sprayed or coated as desired including heat curing of the applied resin as required so as to form a unitized shell of solid reinforced construction.

In one reduction to practice, outer shell 56 of the cartridge assembly was composed of a graphite tape material twelve inches wide, having a tensile strength of 635,000 pounds per square inch, a tensile modulus of $40.4\times10^6$, an ultimate elongation of one and a half percent (1.50%), a carbon content of ninety-four percent (94.0%), a density of 0.0627 pounds per cubic inch and an electric resistance of 15.50 ohms per foot. The outer shell was also composed of an epoxy resin having a density of 0.0452 pounds per cubic inch, a gel temperature of four hundred twenty degrees Fahrenheit (420° F.), a gel time of ten minutes (10 min.) at three hundred fifty degrees Fahrenheit (350° F.), a tensile strength of 6,600 pounds per square inch at seventy-seven degrees Fahrenheit (77° F.), a tensile modulus of 615,000 pounds per square inch, and an elongation of one point one percent (1.1%). When the aforementioned tape and resin materials were utilized in forming the admixture to form shell 56 of cartridge 44, the outer shell was provided with a length of approximately twelve and one-half inches (12.5"), a diameter of approximately twelve inches (12.0") and a thickness of about one-sixteenth of an inch (1/16"). Moreover, the angle of each wound tape of any wrap was plus or minus forty-five degrees (45°) in relation to the axis of shell 56.

Obviously, many modifications and variations of the present invention are possible in light of the above teachings. It is therefore to be understood that within the scope of the appended claims, the invention may be practiced than as otherwise prescribed.

What is claimed is:

1. An intermediate fragmentation warhead section for a missile comprising:

a tubular housing having an inner surface and an opening on at least one end thereof, a removable cylindrical explosive cartridge of composite construction having an inner and outer end and an outer shell operatively sized to reside insertably within said tubular housing; and means for retaining said cylindrical cartridge fixedly attached to said tubular housing in sized relationship to the inner end of said cylindrical cartridge whereby said cartridge is retained longitudinally in a preselected position within said tubular housing; and an annular shoulder affixed to and extending radially within said tubular housing;

an outwardly extending radial flange fixedly attached to the outer end of said cylindrical cartridge sized to correspond to said annual shoulder; and means for fastening said annular shoulder to said corresponding radial flange whereby said cartridge is abuttingly urged against said means for retaining thus fixedly positioning said cartridge within said tubular housing at a preselected position.

2. A warhead section as set forth in claim 1 wherein the inner annular surface of the housing is provided with an internal annular grind design having a pattern of a plurality of intersecting longitudinal and annular grooves so as to assist in dividing up the housing into a plurality of exploding fragments of predetermined size upon detonation of the explosive cartridge during warhead section use.

3. A warhead section as set forth in claim 2 wherein said cylindrical explosive cartridge is formed of graphite material and a suitable grade of resin.

4. A warhead section as set forth in claim 3 wherein the graphite material is a graphite tape.

5. A warhead section as set forth in claim 4 wherein said graphite tape is wound about the shell in at least one direction and at least one angle in relation to the longitudinal axis of the shell.

6. A warhead section as set forth in claim 5 wherein the angle is approximately forty-five degrees (45°).

7. A warhead section as set forth in claim 3 wherein the resin is epoxy.

8. A warhead section as set forth in claim 3 wherein said cylindrical explosive cartridge is formed of electrically conductive material.

9. A warhead section as set forth in claim 1 wherein said explosive cartridge outer shell is of substantially uniform thickness approximately one sixteenth of an inch.

10. A warhead as set forth in claim 3 wherein the graphite material is a graphite filament wound about the axis of the shell in at least one direction.

* * * * *